US006494064B1

(12) United States Patent
Pena

(10) Patent No.: US 6,494,064 B1
(45) Date of Patent: Dec. 17, 2002

(54) CONCEALED AND ENCLOSED LOCK DEVICE

(75) Inventor: Santiago Pena, Dallas, TX (US)

(73) Assignee: Penaco Industries, Inc., Dallas, TX (US)

( * ) Notice: Subject to any disclaimer, the term of this patent is extended or adjusted under 35 U.S.C. 154(b) by 0 days.

(21) Appl. No.: 09/946,435

(22) Filed: Sep. 5, 2001

(51) Int. Cl.[7] ..... E05B 67/38

(52) U.S. Cl. ..... 70/56; 70/129; 70/417; 292/148

(58) Field of Search ..... 70/54–56, 129, 70/417, DIG. 43, DIG. 56; 292/148

(56) References Cited

U.S. PATENT DOCUMENTS

| | | | | | |
|---|---|---|---|---|---|
| 3,606,423 | A | | 9/1971 | McCarthy | |
| 3,736,016 | A | * | 5/1973 | Garvey | 292/281 |
| 4,068,505 | A | * | 1/1978 | Volk, Jr. | 70/56 |
| 4,185,860 | A | | 1/1980 | Bondi | 292/148 |
| 4,229,956 | A | * | 10/1980 | Thorburn | 70/129 |
| 4,234,220 | A | | 11/1980 | Finch et al. | 292/148 |
| 4,372,138 | A | * | 2/1983 | DeForrest | 70/56 |
| 4,437,692 | A | * | 3/1984 | Halopoff | 292/57 |
| 4,480,450 | A | | 11/1984 | Brown | 70/14 |
| 4,655,487 | A | * | 4/1987 | Korn et al. | 292/57 |
| 4,742,701 | A | * | 5/1988 | Scavetto | 70/121 |
| 4,883,294 | A | | 11/1989 | Goodspeed | 292/148 |
| 4,911,486 | A | | 3/1990 | Anderson | 292/148 |
| 4,932,692 | A | | 6/1990 | Nelson | 292/148 |
| 5,092,143 | A | * | 3/1992 | Rumbles | 70/56 |
| 5,150,591 | A | | 9/1992 | Norden, Jr. | 70/129 |
| 5,307,653 | A | * | 5/1994 | Davis | 70/56 |
| 5,931,032 | A | | 8/1999 | Gregory | 70/129 |
| 6,351,975 | B1 | * | 3/2002 | Valdes | 70/56 |

* cited by examiner

*Primary Examiner*—Lloyd A. Gall
(74) *Attorney, Agent, or Firm*—John G. Fischer, Esq.; Storm & Hemingway, LLP.

(57) ABSTRACT

An enclosed and concealed lock device is disclosed which provides a high degree of security. The device is resistant to tampering and to brute force destruction. One or more latches are engageable with a strike plate in a door jamb or with a strike box, which is also enclosed. A seal trim prevents access to the latch. A slide assembly having a padlock is located within a latch enclosure. An orifice on a pivotal link attaches to the shackle of the padlock. Locking the padlock raises the padlock body into the protective latch box enclosure, and prevents movement of the slide assembly. A first limiter restricts vertical movement of the shackle, allowing the padlock to be engaged by upward movement of the padlock body.

44 Claims, 5 Drawing Sheets

FIG. 1
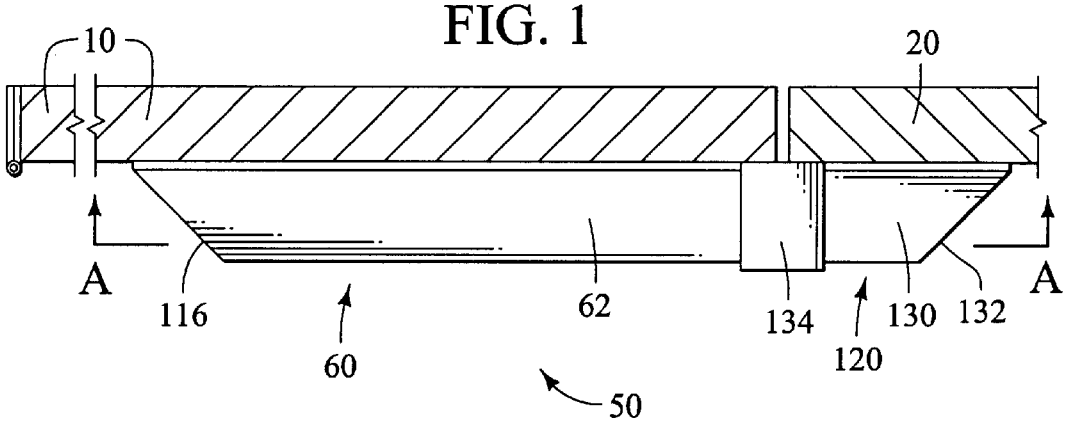
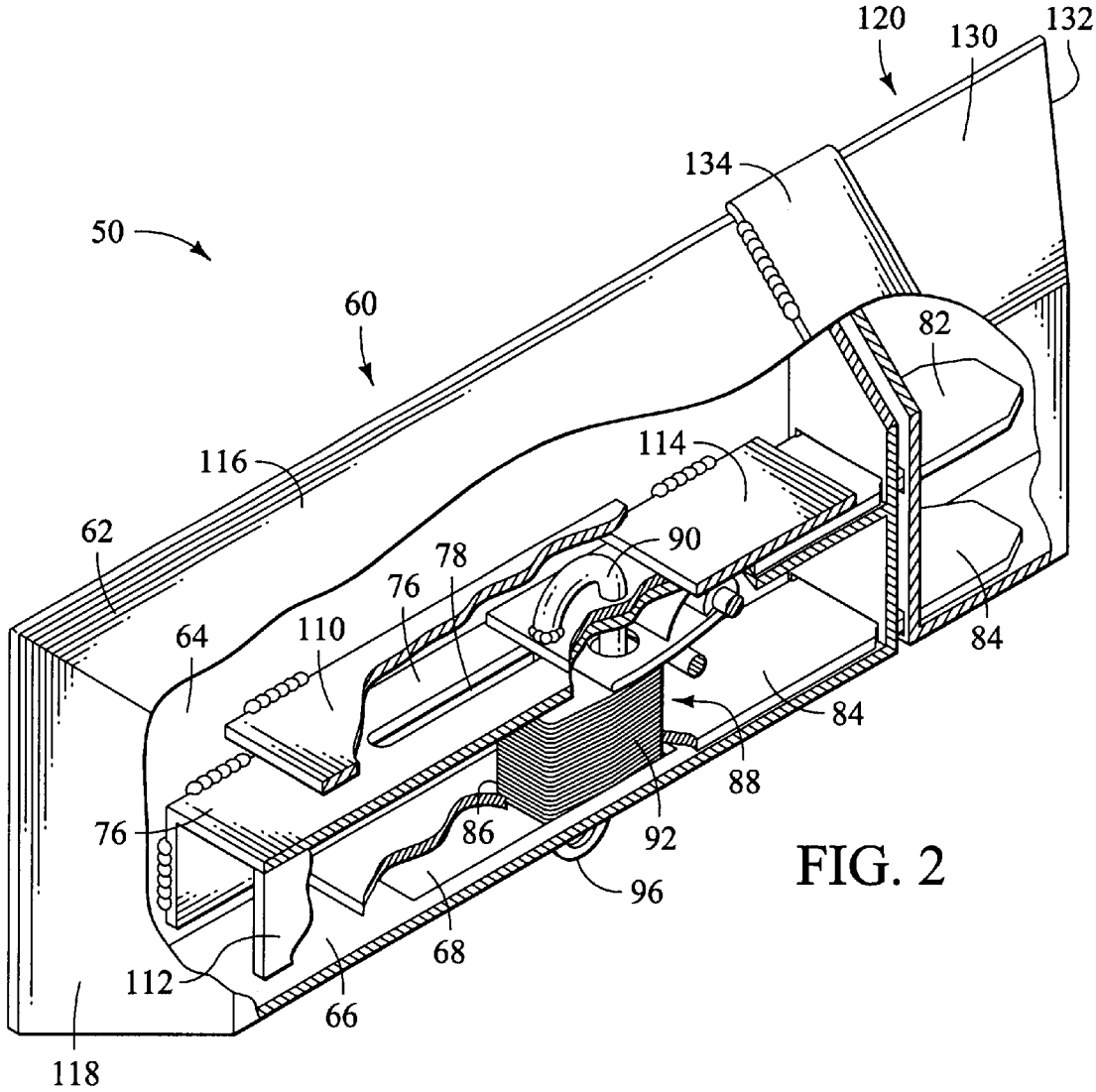
FIG. 2

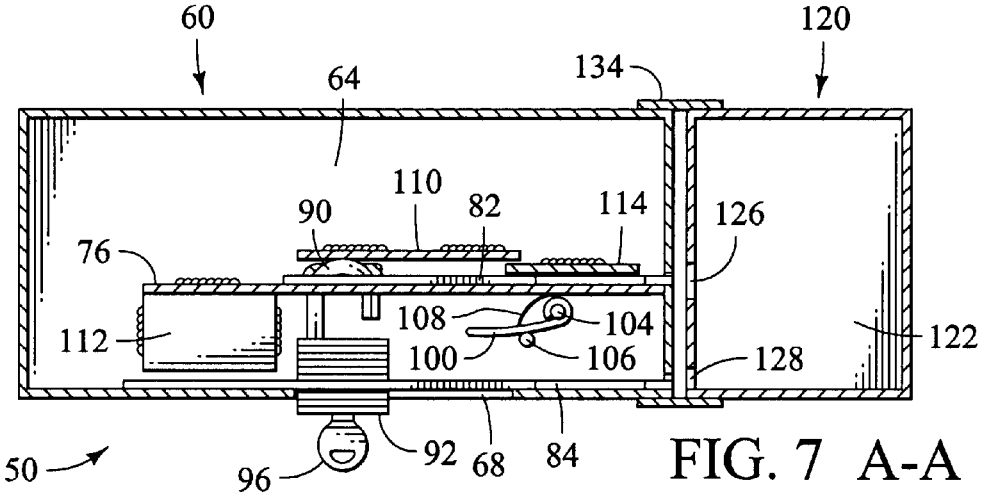
FIG. 7 A-A
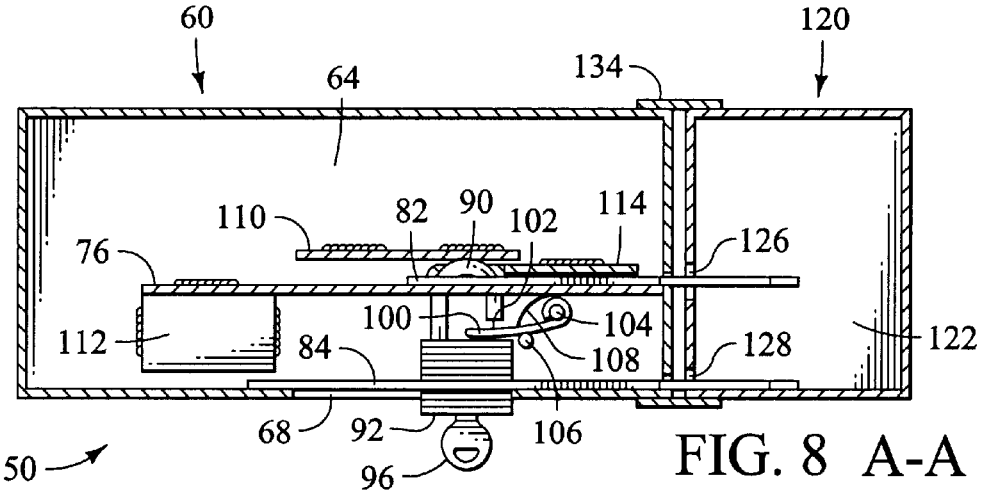
FIG. 8 A-A
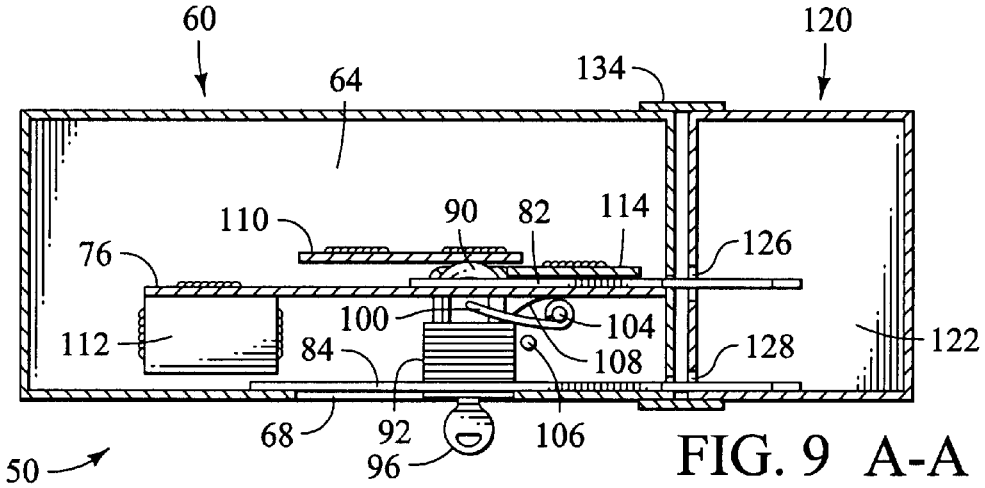
FIG. 9 A-A

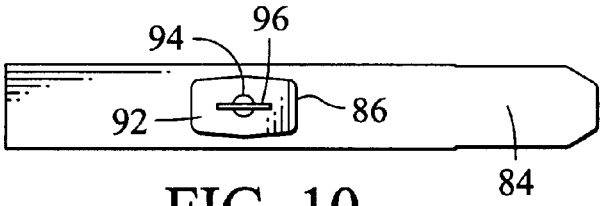
FIG. 10
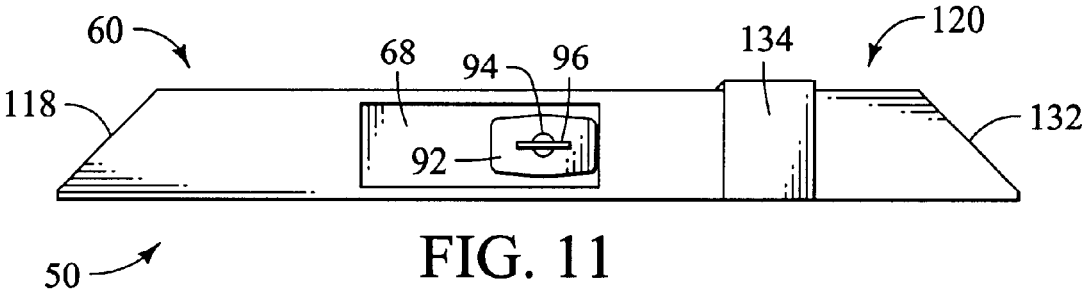
FIG. 11
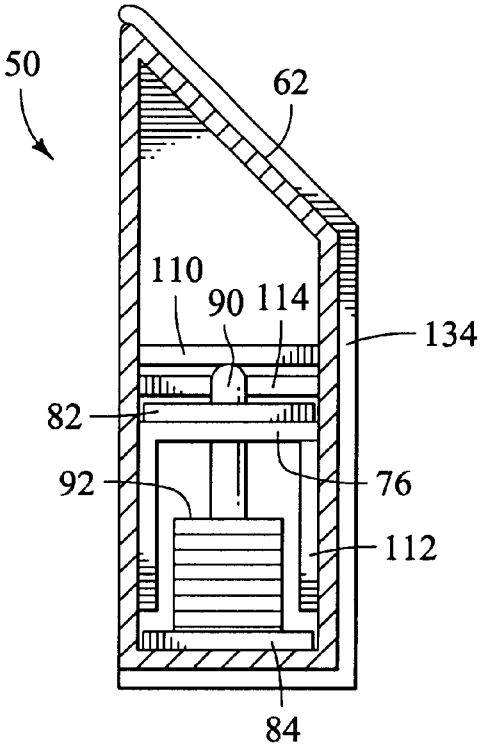
FIG. 12 B-B

CONCEALED AND ENCLOSED LOCK DEVICE

CROSS-REFERENCE TO RELATED APPLICATION

None.

BACKGROUND OF THE INVENTION

1. Technical Field

This invention relates generally to locking devices used to lock doors on trucks, buildings, storage containers, railroad cars, freight containers, warehouses and the like, and in particular to a defensively enclosed locking device that resists intruders' attempts to physically overpower the device.

2. Description of Related Art

Virtually all commercial entities and private citizens have ownership or responsibility for property that must be secured at some time during transportation or storage. The most popular means of securing a storage space containing property is by locking the access to the storage space with a door lock, deadbolt, or padlock. Padlocks are small, very strong, inexpensive, and convenient to use. They provide greater protection than other forms of locks used in storage spaces that are not considered vaults. The simple design, interchangeability, and worldwide availability of these devices add to their usefulness. Therefore, millions of access doors are fitted to receive padlocks.

As the value of the stored property increases, so does the incentive for thieves to break into the storage space and steal the property. Property owners most often respond by increasing the size of the padlock, or by using multiple padlocks. Unfortunately, professional thieves can destroy padlocks in a matter of seconds, by employing large steel prybars to leverage and rupture either the locks or the latching assemblies. Thus, secured storage of high value property in a storage space continues to be a problem.

Since the loss of high value property is, by definition, economically more devastating than the loss of low value property, enhanced locking and security systems are economically justifiable. To address the problems of secured storage of high value property in a storage space, attempts have been made to design protective coverings for the locks and for latching assemblies. One such attempt is disclosed in U.S. Pat. No. 4,911,486, issued to Anderson. In the '486 patent, a tamper-resistant slide bolt and padlock combination is disclosed. However, in the disclosed design, the latching assembly and lock remain substantially exposed to destruction by forcible entry. Other attempts to provide enhanced security to latch assemblies and locks similarly fail to prevent theft. Many of the assemblies permit visibility of their structure, which allows criminals an opportunity and incentive to further investigate and attempt alternative means for destroying the locks and assemblies. Bolt-cutters are only one of the tools used by thieves. For example, many devices permit sufficient access to the latch bolt to allow the use of a hacksaw. Other devices permit access to the latching assembly with chisels and sledgehammers, long steel prybars, and small explosives. Thus there is a need for a device that provides a secure enclosure for latching assemblies and locks which conceals its structure and is impervious to forcible entry.

BRIEF SUMMARY OF THE INVENTION

A primary advantage of the present invention is that it provides both a concealed and enclosed lock device.

Another advantage of the present invention is that it incorporates the use of reliable and inexpensive padlocks as the locking mechanism. Another advantage of the present invention is that it provides an enclosure that prevents access to the shackle of the padlock. Another advantage of the present invention is that it provides an enclosure that prevents access to the latch. Another advantage of the present invention is that it provides an enclosure that prevents access to the strike plate. Another advantage of the present invention is that it provides an enclosure that resists damage from impact. Another advantage of the present invention is that it provides an enclosure that provides the option of a dual latch mechanism. Other advantages of the present invention will become apparent from the following descriptions, taken in connection with the accompanying drawings, wherein, by way of illustration and example, an embodiment of the present invention is disclosed.

In a preferred embodiment of the present invention, a concealed and enclosed lock device is disclosed, having a latch box enclosure. The latch box has a backplate, and a baseplate extending outward from the backplate. The backplate has a lock slot. A guide bar having a channel is attached to the backplate. A link is pivotally attached to the backplate on one end, and has an orifice on the opposite end. A first limiter is also attached to the backplate. A slide assembly is located inside the latch box. The slide assembly has an upper latch slidably located above the guide bar, and a lower latch slidably located above the baseplate. The lower latch has a lock portal. A padlock having a shackle and a lock body with a keyhole is used as the locking device. The top of the shackle passes through the channel of the guide bar and is attached to the upper latch. The body of the padlock passes through the portal and extends into the lock slot. In another preferred embodiment, a strike box is provided. The strike box may have a strike plate with a first slot for receiving the upper latch, and a second slot for receiving the lower latch.

BRIEF DESCRIPTION OF THE SEVERAL VIEWS OF THE DRAWING(S)

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 is a top view of the preferred embodiment of the enclosed lock device of the present invention.

FIG. 2 is an isometric sectional view of the embodiment of the enclosed lock device shown in FIG. 1, with the latch in the latched position and the lock in the locked position.

FIG. 4 is a front view of a preferred embodiment of the enclosed lock device of the present invention in the unlatched and unlocked position.

FIG. 5 is a front view of a preferred embodiment of the enclosed lock device of the present invention in the latched, but unlocked position.

FIG. 6 is a front view of a preferred embodiment of the enclosed lock device of the present invention in the latched and locked position.

FIGS. 7–9 are a sequence of front sectional drawings showing the progressive steps of latching and locking the device of the present invention, as shown in FIGS. 4–6, sectioned as shown in FIG. 1.

FIG. 7 is a front sectional view of a preferred embodiment of the enclosed lock device of the present invention in the unlatched and unlocked position as shown in FIG. 4, sectioned as shown in FIG. 1.

FIG. 8 is a front view of a preferred embodiment of the enclosed lock device of the present invention in the latched, but unlocked position as shown in FIG. 5, sectioned as shown in FIG. 1.

FIG. 9 is a front view of a preferred embodiment of the enclosed lock device of the present invention in the latched and locked position as shown in FIG. 6, sectioned as shown in FIG. 1.

FIG. 10 is a bottom view of a preferred embodiment of the slide assembly of the lock device of the present invention, showing the lock body protruding through the lock portal of the lower latch.

FIG. 11 is a bottom view of a preferred embodiment of the enclosed lock device of the present invention in the latched position.

FIG. 12 is a sectional end of a preferred embodiment of the enclosed lock device of the present invention, sectioned as shown in FIG. 6.

DETAILED DESCRIPTION OF THE INVENTION

Figure 3:
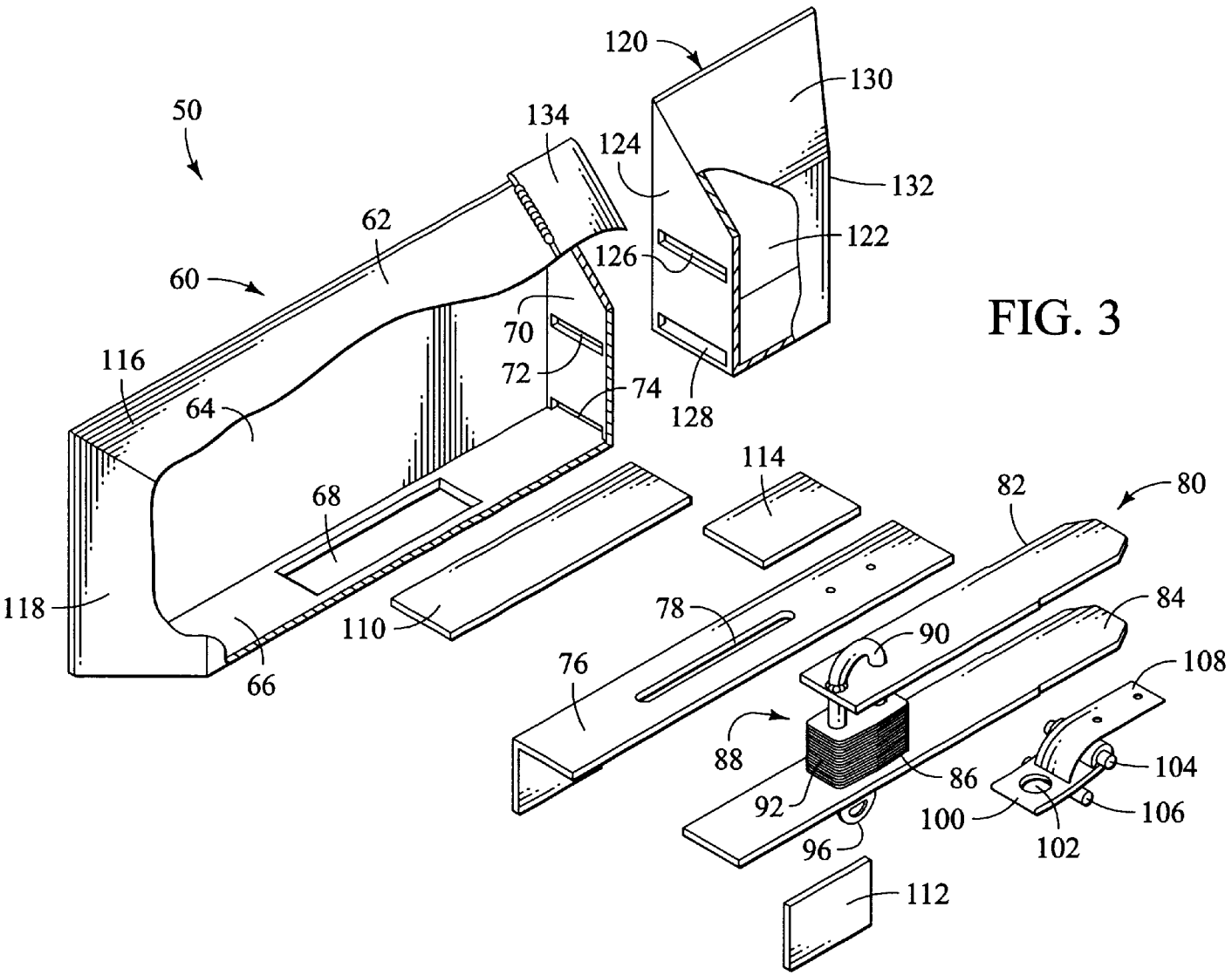
FIG. 3 is an isometric exploded view of the embodiment of the enclosed lock device shown in FIG. 1 and FIG. 2.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

FIG. 1 is a front view, showing a first door 10 and a second door 20 which operate in complementary alignment to provide access to a storage space. It is understood, and will be understood by a person of ordinary skill in the art, that for all purposes throughout this disclosure, either first door 10 or second door 20 could be a doorframe, wall, or other stationary structure rather than a door, without changing the principles, application, meaning, or function of the presently disclosed invention. All that is necessary is that one or both of structure (first door) 10 and structure (second door) 20 is a door that opens relative to the other. Likewise, the use, content, transportability, and size of space are irrelevant to the principles, application, meaning, and function of the presently disclosed invention. Also, it will be understood by a person of ordinary skill in the art that doors are commonly made to have both left and right hand openings, depending on the application and therefore the configuration shown in the attached figures may be reversed.

In FIG. 1, enclosed lock device 50 is shown generally from a top view. In this figure, a latch box 60 cooperates with a strike box 120 to securely lock first door 10 to second door 20.

FIG. 2 is an isometric cut-away view of a preferred embodiment of lock device 50. FIG. 3 is an isometric explosion view of the embodiment of FIG. 2. In FIG. 2, it is seen that latch box 60 forms an enclosure having a backplate 64 for attachment of latch box 60 to first door 10, or doorframe, wall, or other stationary element (not shown in this view). In a preferred embodiment, latch box 60 has a baseplate 66 attached to the bottom of backplate 64. Baseplate 66 has a lock slot 68. In the less preferred embodiment, there is no baseplate 66, and the opening at the bottom of latch box 60 constitutes lock slot 68. In a preferred embodiment, latch box 60 also has an end plate 70. In this embodiment, end plate 70 has an upper slot 72. In a more preferred embodiment, end plate 70 also has a lower slot 74.

A guide bar 76 is attached to backplate 64 as shown in FIG. 2. In a preferred embodiment, guide bar 76 is attached to backplate 64 substantially parallel to baseplate 66. Referring back to FIG. 3, guide bar 76 has a channel 78. A slide assembly 80 has an upper latch 82. In a more preferred embodiment, slide assembly 80 also has a lower latch 84. Lower latch 84 has a lock portal 86. A padlock 88 has a latchable shackle 90 extending from a lock body 92. FIG. 10 is a bottom view of slide assembly 80. As seen best in FIG. 10, a keyhole 94 in the bottom of lock body 92 receives a key 96 for releasing shackle 90 from lock body 92.

Alternatively, an equivalent release mechanism such as a combination dial may be used. Lock body 92 is positioned inside lock portal 86. Shackle 90 is attached by weld or other means to upper latch 82.

In an alternative embodiment not shown, guide bar 76 is a guide rod 76, and shackle 90 loops over guide rod 76. In this embodiment, lower latch 84 may optionally be used to the exclusion of upper latch 82.

As best seen in FIG. 2, slide assembly 80 is located inside latch box 60. Lower latch 84 is positioned on top of baseplate 66, in slidable relation. Upper latch 82 is located on top of guide bar 76, in slidable relation. In the configuration of this embodiment, shackle 90 slides horizontally inside channel 78, and lock body 92 slides horizontally inside lock slot 68. Channel 78 limits the horizontal range of motion of slide assembly 80 in either direction. Lock body 92 is vertically movable through lock portal 86, permitting the locking and unlocking of padlock 88 without interference with baseplate 66.

Upper latch 82 extends and retracts outwardly from latch box 60 for engagement and disengagement with a strike plate in a door jamb, or with optional strike box 120. In a preferred embodiment, upper latch 82 extends and retracts through upper slot 72 of end plate 70, and lower latch 84 extends and retracts through lower slot 74 of end plate 70. As best seen in FIG. 3, a rotatable link 100 is attached to backplate 64 of latch box 60. Link 100 has an orifice 102 receivable of shackle 90 of padlock 88. In a preferred embodiment, link 100 is pivotally attached to a link pin 104, which is attached to backplate 64. In another preferred embodiment, a positioning means such as a link stop 106 is attached to backplate 64 to properly align link 100 to pass through the opening between shackle 90 and lock body 92 when padlock 88 is unlocked. In another preferred embodiment, a spring member 108 is attached to a surface inside of latch box 60, such as guide bar 76, to assure repositioning of link 100 against link stop 106 when padlock 88 is unlocked. A person of ordinary skill in the art will appreciate that spring member 108 may be attached to guide bar 76 as shown in FIG. 2, or in various alternative configurations which will have the equivalent function and result of repositioning of link 100 against link stop 106.

In another preferred embodiment, a first limiter 110 is attached inside of latch box 60 to limit the vertical movement of shackle 90. This is necessary to permit locking of padlock 88 by vertically upward movement of lock body 92 against shackle 90. A person of ordinary skill in the art will appreciate that first limiter 110 may be attached directly to backplate 64 as shown in FIG. 2, or in various alternative configurations which result in the equivalent function and result of restraining vertical movement of shackle 90. For example, by virtue of the attachment of shackle 90 to upper latch 82 in this embodiment, first limiter 110 can limit the vertical movement of shackle 90 by engagement with upper latch 82, and thus achieve the same result. In this example, first limiter 110 can be a roller, plate, or other geometry designed to engage upper latch 82 and limit upward movement.

In another alternative embodiment, a second limiter 112 is attached inside of latch box 60 to limit the vertical movement of lower latch 84. Second limiter 112 can be a roller, plate, or other geometry designed to engage lower latch 84 upon upward movement. Intersection of lower latch 84 into lower slot 74 restricts movement of one end of lower latch 84. Second limiter 112 can be attached to restrict movement of the opposite end of lower latch 84, resulting in a more stable and secure assembly. A person of ordinary skill in the art will appreciate that second limiter 112 may be attached to guide bar 76 as shown in FIG. 2, or in various alternative configurations which result in the equivalent function and result of restraining vertical movement of lower latch 84. For example, second limiter 112 may alternatively be attached to backplate 64, or to lower latch 84.

In the preferred embodiment, channel 78 limits the horizontal range of motion of slide assembly 80 in either direction. In another alternative embodiment, a travel limiter 114 is attached inside of latch box 60 to limit the horizontal travel of slide assembly 80 when latching door 10 and door 20 together. Travel limiter 114 limits the horizontal travel to permit alignment of shackle 90 with orifice 102, and thus facilitates locking of padlock 88. It is considered preferred to limit the travel of slide assembly 80 in the "latching" direction by a means other than the contact of lock body 92 with the terminal end of lock slot 68, since that configuration would potentially interfere with the vertical movement of lock body 92 when locking padlock 88. Travel limiter 114 may be attached to backplate 64 as shown in FIG. 2, wherein it also performs the additional function of limiting the vertical movement of upper latch 82, further stabilizing the assembly of lock device 50. In another preferred embodiment, first limiter 110 is positioned such that it performs the function of both first limiter 110 and of travel limiter 114.

A person of ordinary skill in the art will appreciate that travel limiter 114 may be attached in various alternative configurations which have the equivalent function and result of restraining horizontal travel of slide assembly 80. For example, travel limiter 114 may alternatively be attached to, or integral with, first limiter 110, or with link stop 106, or even with link 100. In another, less preferred configuration, travel limiter 114 may be located within the strike box (discussed below) where it can engage the ends of upper latch 82 or lower latch 84 to limit the horizontal travel of slide assembly 80. In this example, the interior of the strike box itself can act as a travel limiter.

In another preferred embodiment, latch box 60 has a beveled top surface 116. In another preferred embodiment, latch box 60 has a beveled end surface 118. The beveling of exterior surfaces 116 and 118 increases the difficulty of destroying latch box 60 by blows with a heavy sledge hammer or other device. Beveling is meant to include radiusing, chamfering, or otherwise creating a non-rectilinear exterior surface.

As stated above, and as shown in FIG. 1, latch box 60 cooperates with strike box 120 to securely lock first door 10 to second door 20. Alternatively, latch box 60 may cooperate with a strike plate 124 in a door jamb that is receivable of upper latch 82 and lower latch 84, without the need for separate strike box 120. In FIG. 3, it is seen that strike box 120 forms an enclosure having a backplate 122 for attachment of strike box 120 to second door 20, or doorframe, wall, or other stationary element (not shown in this view). In a preferred embodiment, strike box 120 has a strike plate 124. In this embodiment, strike plate 124 has an upper strike slot 126 and a lower slot 128. In a preferred embodiment, strike box 120 has a beveled top surface 130. In another preferred embodiment, strike box 120 has a beveled end surface 132. The beveling of exterior surfaces 130 and 132 increases the difficulty of destroying strike box 120 by blows with a heavy sledge hammer or other device. Beveling is meant to include radiusing, chamfering, or otherwise creating a non-rectilinear exterior surface.

In another preferred embodiment, a seal trim 134 is attached to latch box 60. Seal trim 134 conceals and encloses the space between latch box 60 and strike box 120.

Operation of the Invention

In a preferred embodiment of the present invention, concealed and enclosed lock device 50 is disclosed, having latch box 60 and strike box 120.

Figure 4:
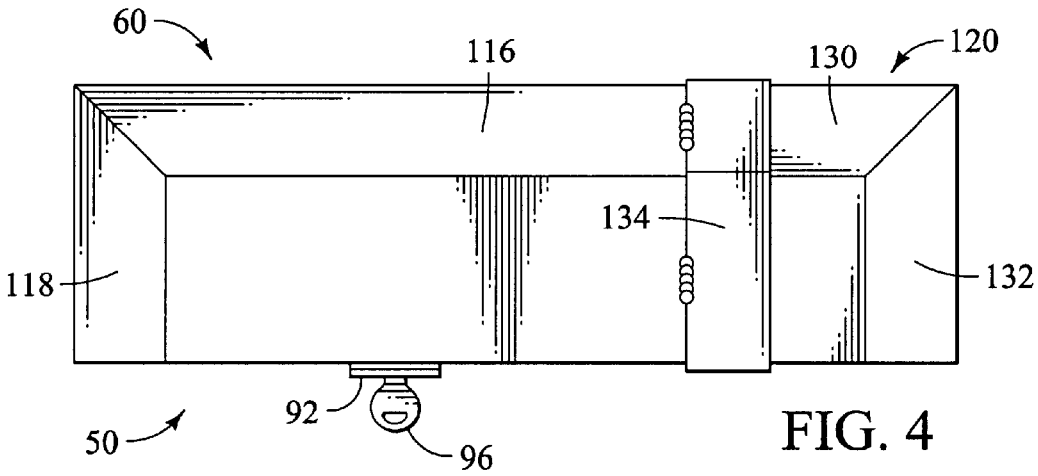
FIGS. 4–6 are a sequence of drawings showing the progressive steps of latching and locking the device of the present invention.
Figure 5:
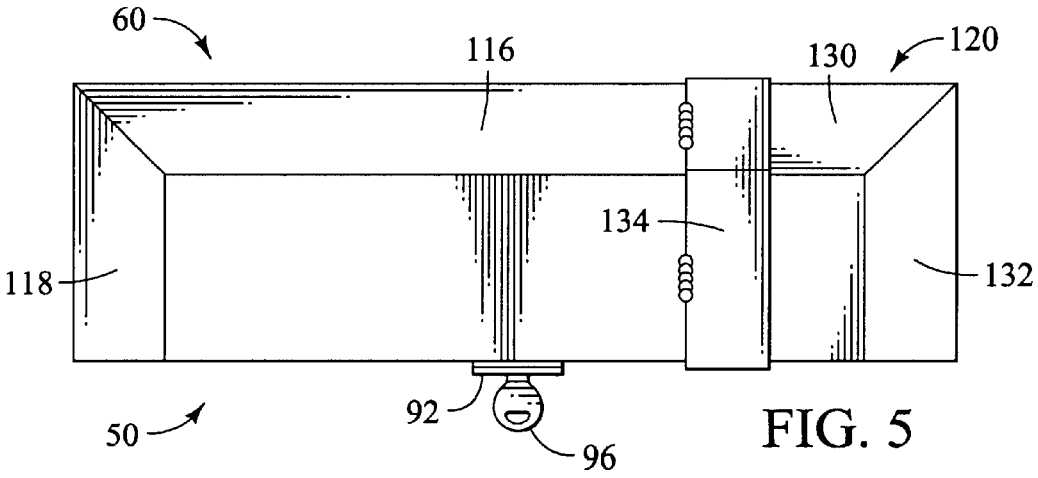
Figure 6:
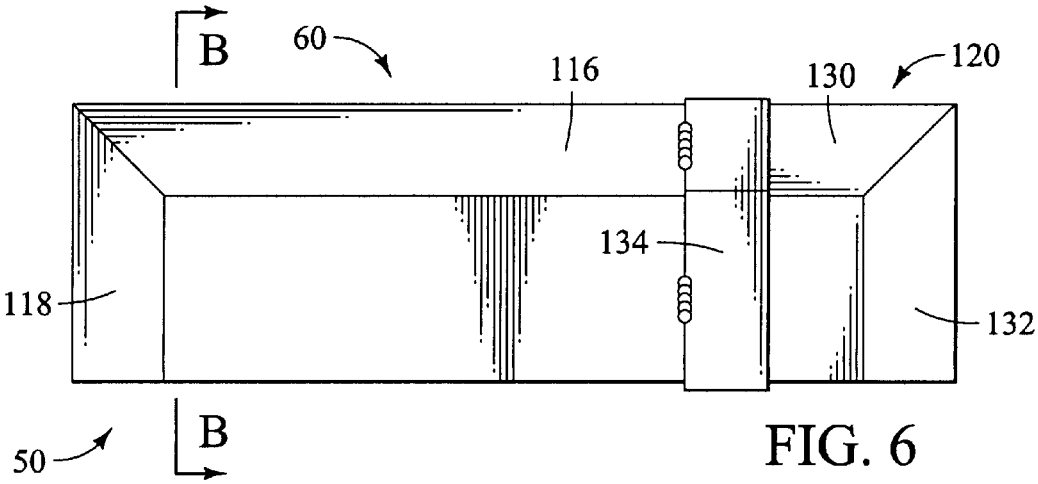

FIGS. 4–6 are a sequence of drawings showing the progressive steps of latching and locking lock device 50 of the present invention. FIGS. 7–9 are a corresponding sequence of front sectional drawings showing the same progressive steps of latching and locking lock device 50, as shown in FIGS. 4–6. FIGS. 7–9 are sectioned as shown in FIG. 1.

FIG. 4 is a front view of a preferred embodiment of lock device 50 in the unlatched and unlocked position. In this view, it is seen that lock body 92 extends below latch box 60, and is thus accessible. FIG. 7 is a front sectional view of the same embodiment of lock device 50, shown in the same position. In this view, it is seen that shackle 90 is disengaged from lock body 92 of padlock 88. Slide assembly 80 has been slid horizontally to the left until lock body 92 rests against the end of lock slot 68. Upper latch 82 and lower latch 84 are disengaged from strike plate 124, allowing free relative movement between latch box 60 and strike box 120, and thus free movement between doors 10 and 20 (not shown in this view). In the embodiment shown, spring member 108 presses link 100 against link stop 106. Absent spring member 108, gravity will force link 100 against link stop 106. In this position, link 100 and orifice 102 are located in relation to the space between uncoupled shackle 90 and lock body 92. Even in the unlocked position, padlock 88 cannot be removed from latch box 60.

FIG. 5 is a front view of a preferred embodiment of enclosed lock device 50 in the latched, but unlocked position. In this view, and as compared to FIG. 4, it is seen that lock body 92 has been moved horizontally to the right, and still extends below latch box 60, and is thus accessible. The extension of lock body 92 below latch box 60 permits the operator to grasp lock body 92 and slide it left or right. FIG. 8 is a front sectional view of the same embodiment of the disclosed device, shown in the same position. In this view, it is again seen that slide assembly 80 has been moved horizontally to the right as compared to FIG. 7. When lock body 92 is moved horizontally, intersection of lock body 92 with portal 86 causes coincident movement of lower latch 84. Attachment of shackle 90 to upper latch 82 causes similar coincident movement of upper latch 82. Horizontal travel is limited by contact between shackle 90 and the end of channel 78. In an alternative embodiment, horizontal travel of slide assembly 80 is limited by contact between shackle 90 and travel limiter 114. It is also seen in this view that shackle 90 remains disengaged from lock body 92 of padlock 88. Lock body 92 has moved into a position beneath link 100, aligning orifice 102 with the open end of shackle 90 to permit locking padlock 88. Upper latch 82 and lower latch 84 engage strike box 120 through first slot 126 and second slot 128 respectively, prohibiting relative movement between latch box 60 and strike box 120, and thus preventing movement between doors 10 and 20 (not shown in this view).

It can be seen in this view that there are a number of alternative but equivalent configurations by which limitation of the horizontal travel of slide assembly 80 may be accomplished. In particular, and as described hereinabove, first limiter 110 may be positioned so as to perform the functions of both first limiter 110 and travel limiter 114.

FIG. 6 is a front view of a preferred embodiment of enclosed lock device 50 of the present invention in the latched, and locked position. In this view, and as compared to FIG. 5, it is seen that lock body 92 has been moved vertically upwards by the operator, and it no longer extends below latch box 60. The movement of lock body 92 vertically upwards conceals lock body 92 and renders it generally inaccessible. FIG. 9 is a front sectional view of the same embodiment of the disclosed device, shown in the same position. In this view, it is again seen that by lifting lock body 92 vertically upward, the operator has caused shackle 90 to engage lock body 92, locking padlock 88 through orifice 102 of link 100. When the operator lifted lock body 92 vertically upwards, shackle 90 engaged first limiter 110, limiting upward travel of shackle 90 relative to lock body 92. Continued upward movement of lock body 92 caused lock body 92 to engage and rotate link 100 until the open end of shackle 90 passes through orifice 102. Still further upward movement of lock body 92 resulted in locked connection of shackle 90 with lock body 92.

Engagement of shackle 90 with travel limiter 114 prevents engagement of lock body 92 with the end of lock slot 68. While there are numerous equivalent means for limiting the rightmost horizontal travel of slide assembly 80, it is generally undesirable to limit the movement by engagement of lock body 92 with lock slot 68, since this could result in interference with the vertical movement of lock body 92 when the operator desires to lock padlock 88. Upper latch 82 and lower latch 84 remain engaged with strike box 120, and now lock device 50 is locked.

As seen in FIG. 6, lock device 50 presents a fortress around padlock 88. Trim seal 134 prevents any access to upper latch 82 and lower latch 84. In the embodiment shown, latch box 60 has a beveled exterior top surface 116 and a beveled exterior end surface 118. Also in the embodiment shown, strike box 120 has a beveled exterior top surface 130 and a beveled exterior end surface 132. The beveling of these exterior surfaces vastly increases the difficulty of destroying latch box 60 or strike box 120 by blows with a heavy sledge hammer or other device.

FIG. 11 is a bottom view of the same embodiment of the disclosed device, shown in the same latched and locked position as shown in FIG. 6 and FIG. 9. In this view it is seen that keyhole 94 is receivable of key 96 for unlocking of padlock 88. When the operator wishes to unlock lock device 50, keyhole 94 of padlock 88 is concealed, but accessible from the bottom of lock device 50. By unlocking padlock 88, lock body 92 will withdraw from shackle 90, and extend below latch box 60, as seen in FIG. 5. Lock body 92 may then be grasped by the operator and moved horizontally to the left to disengage upper latch 82 and lower latch 84 from strike box 120, as seen in FIG. 4.

FIG. 12 is a sectional end of the same embodiment of the enclosed lock device of the present invention, sectioned as shown in FIG. 6, and shown again in the latched and locked position. In this figure the relationship between the components of slide assembly 80 (shackle 90, lock body 92, upper latch 82, lower latch 84) and latch box 60 can be seen from an end view.

While this invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

I claim:

1. A concealed and enclosed lock device, comprising:

a latch box enclosure having;

a backplate;

a guide bar extending outward from the backplate, and having a channel;

a link pivotally attached to the backplate on one end, and having an orifice on the opposite end;

a first limiter extending outward from the backplate above the guide bar;

a slide assembly having;

an upper latch slidably located between the guide bar and the first limiter; and, a padlock having a shackle and a lock body, the top of the shackle passing through the channel of the guide bar and being attached to the upper latch.

2. The lock device of claim 1, further comprising:

a base plate extending outward from the back plate, and having a lock slot.

3. The lock device of claim 2, further comprising:

a lower latch slidably located above the baseplate, the lower latch having a lock portal.

4. The enclosed lock device of claim 3 further comprising:

a second limiter positionally attached within the latch box to limit vertical movement of the lower latch.

5. The lock device of claim 1, further comprising:

an end plate having at least one slot for passage of a latch.

6. The lock device of claim 1, further comprising:

a strike box receivable of at least one latch.

7. The lock device of claim 6, the strike box further comprising:

a strike plate having at least one slot receivable of a latch.

8. The lock device of claim 1, wherein the channel limits the horizontal range of travel of the slide assembly.

9. The lock device of claim 1, wherein the first limiter limits both the vertical and horizontal ranges of travel of the slide assembly.

10. The enclosed lock device of claim 1 further comprising:

a travel limiter positionally attached within the latch box to limit horizontal range of travel of the slide assembly.

11. The enclosed lock device of claim 1, further comprising:

a link stop which limits the angular rotation of the link.

12. The enclosed lock device of claim 1, further comprising:

a spring member, which urges the link to a position between the open end of the shackle and the lock body when the padlock is unlocked.

13. The enclosed lock device of claim 11, further comprising:

a spring member, which urges the link against the link stop.

14. The enclosed lock device of claim 1 further comprising:

wherein the latch box has a beveled exterior surface.

15. The enclosed lock device of claim 6 further comprising:

wherein the strike box has a beveled exterior surface.

16. The enclosed lock device of claim 6 further comprising:

a seal trim attached to the latch box which overlaps the strike box, concealing the space between them.

17. A concealed and enclosed lock device, comprising:

a latch box enclosure having;

a backplate;

a base plate extending outward from the backplate and having a lock slot;

a guide attached outwardly of the backplate;

a link pivotally attached to the backplate on one end, and having an orifice on the opposite end;

a first limiter extending outward from the backplate above the guide; and, a slide assembly having;

a padlock having a shackle and a lock body, the top of the shackle passing over the guide; and, a lower latch slidably located above the baseplate, the lower latch having a lock portal through which the lock body extends.

18. The lock device of claim 17, further comprising:

an upper latch slidably located between the guide and the first limiter, and attached to the shackle.

19. The enclosed lock device of claim 17 further comprising:

a second limiter positionally attached within the latch box to limit vertical movement of the lower latch.

20. The lock device of claim 17, further comprising:

an end plate having at least one slot for passage of a latch.

21. The lock device of claim 17, further comprising:

a strike box receivable of at least one latch.

22. The lock device of claim 21, the strike box further comprising:

a strike plate having at least one slot for receivable of a latch.

23. The lock device of claim 17, wherein the first limiter limits the vertical and horizontal range of travel of the slide assembly.

24. The enclosed lock device of claim 17, further comprising:

a travel limiter positionally attached within the latch box to limit horizontal movement of the slide assembly.

25. The enclosed lock device of claim 17, further comprising:

a link stop which limits the angular rotation of the link.

26. The enclosed lock device of claim 17, further comprising:

a spring member, which urges the link to a position between the open end of the shackle and the lock body when the padlock is unlocked.

27. The enclosed lock device of claim 25, further comprising:

a spring member, which urges the link against the link stop.

28. The enclosed lock device of claim 17, further comprising:

wherein the latch box has a beveled exterior surface.

29. The enclosed lock device of claim 21, further comprising:

wherein the strike box has a beveled exterior surface.

30. The enclosed lock device of claim 22, further comprising:

a seal trim attached to the latch box which overlaps the strike box, concealing the space between them.

31. A secured and enclosed lock device, comprising:

a latch box having;

a backplate;

a baseplate extending outward from the backplate, and having a lock slot;

a guide bar extending outward from the backplate, and having a channel;

a link pivotally attached to the backplate on one end, and having an orifice on the opposite end;

a first limiter attached to the backplate; and, a slide assembly having;

an upper latch slidably located above the guide bar;

a lower latch slidably located above the baseplate, the lower latch having a lock portal; and, a padlock having a shackle and a lock body, the top of the shackle passing through the channel of the guide bar, and being attached to the upper latch, the body passing through the portal, and extending into the lock slot when the padlock is in the unlocked position.

32. The lock device of claim 31, further comprising:

an end plate having an upper slot for passage of the upper latch and a lower slot for passage of the lower latch.

33. The lock device of claim 31, further comprising:

a strike box receivable of the upper latch and the lower latch.

34. The lock device of claim 33, the strike box further comprising:

a strike plate having a first slot for receiving the upper latch and a second slot for receiving the lower latch.

35. The lock device of claim 31, wherein the channel limits the horizontal range of travel of the slide assembly.

36. The lock device of claim 31, wherein the first limiter limits both the vertical and horizontal ranges of travel of the slide assembly.

37. The enclosed lock device of claim 31, further comprising:

a second limiter positionally attached within the latch box to limit vertical movement of the lower latch.

38. The enclosed lock device of claim 31, further comprising:

a travel limiter positionally attached within the latch box to limit horizontal range of travel of the slide assembly.

39. The enclosed lock device of claim 31, further comprising:

a link stop which limits the angular rotation of the link.

40. The enclosed lock device of claim 31, further comprising:

a spring member, which urges the link to a position between the open end of the shackle and the lock body when the padlock is unlocked.

41. The enclosed lock device of claim 39, further comprising:

a spring member, which urges the link against the link stop.

42. The enclosed lock device of claim 31, further comprising:

wherein the latch box has a beveled exterior surface.

43. The enclosed lock device of claim 33, further comprising:

wherein the strike box has a beveled exterior surface.

44. The enclosed lock device of claim 33, further comprising:

a seal trim attached to the latch box which overlaps the strike box, concealing the space between them.

* * * * *